US010897986B2

(12) United States Patent
Treacy

(10) Patent No.: US 10,897,986 B2
(45) Date of Patent: Jan. 26, 2021

(54) BRUSH DEVICE THAT DISPENSES CLEANING FLUID

(71) Applicant: Terry Treacy, Fort Worth, TX (US)

(72) Inventor: Terry Treacy, Fort Worth, TX (US)

( * ) Notice: Subject to any disclaimer, the term of this patent is extended or adjusted under 35 U.S.C. 154(b) by 0 days.

(21) Appl. No.: 15/440,046

(22) Filed: Feb. 23, 2017

(65) Prior Publication Data

US 2018/0000238 A1 Jan. 4, 2018

Related U.S. Application Data

(60) Provisional application No. 62/303,653, filed on Mar. 4, 2016.

(51) Int. Cl.
*A46B 11/02* (2006.01)
*A46B 11/00* (2006.01)

(52) U.S. Cl.
CPC ..... *A46B 11/001* (2013.01); *A46B 11/002* (2013.01); *A46B 2200/3033* (2013.01)

(58) Field of Classification Search
CPC ..... A46B 11/002; A46B 11/0041; A46B 11/0079
USPC ..... 401/184
See application file for complete search history.

(56) References Cited

U.S. PATENT DOCUMENTS 2,761,833 A * 9/1956 Ward ..... C02F 1/003 210/85
6,805,512 B2 * 10/2004 King ..... A45D 34/045 401/133
7,040,830 B2 * 5/2006 Kliegman ..... A46B 11/0013 401/187
7,461,993 B1 * 12/2008 Sampaio ..... A46B 5/002 401/183
2010/0155431 A1 * 6/2010 Bartolucci ..... B05C 17/00583 401/171

* cited by examiner

*Primary Examiner* — Jennifer C Chiang
(74) *Attorney, Agent, or Firm* — Handley Law Firm, PLLC

(57) ABSTRACT

A brush device for dispensing a cleaning fluid may include a cleaning head section; a neck section connected to the cleaning head section; a handle section connected to the neck section; a bellows formed in the neck section to apply the cleaning fluid to the cleaning head section; a dispensing outlet valve being formed in the cleaning head section to dispense the cleaning fluid from the brush device; a handle cap being removable and formed in the handle section. The cleaning brush may be integral formed except for the bellows, the dispensing outlet valve and the handle cap.

5 Claims, 6 Drawing Sheets

BRUSH DEVICE THAT DISPENSES CLEANING FLUID

FIELD OF THE INVENTION

The present invention relates to a brush device and more particularly to a brush device that dispenses cleaning fluid.

BACKGROUND

A persistent problem is the need to clean utensils that have been used associated with the preparation and consumption of food, particularly utensils that have been used in baking food. These utensils are difficult to clean and generally require the application of large amounts of cleaning fluid.

SUMMARY

A brush device for dispensing a cleaning fluid may include a cleaning head section; a neck section connected to the cleaning head section; a handle section connected to the neck section; a bellows formed in the neck section to apply the cleaning fluid to the cleaning head section; a dispensing outlet valve being formed in the cleaning head section to dispense the cleaning fluid from the brush device; a handle cap being removable and formed in the handle section.

The cleaning brush may be integral formed except for the bellows, the dispensing outlet valve and the handle cap.

The cleaning head section may include a pair of opposing guides.

The neck section may include an aperture to cooperate with the bellows.

The dispensing outlet valve may be positioned on a bottom surface of the cleaning head section.

BRIEF DESCRIPTION OF THE DRAWINGS

The invention may be understood by reference to the following description taken in conjunction with the accompanying drawings, in which, like reference numerals identify like elements, and in which.

DETAILED DESCRIPTION

Figure 1:
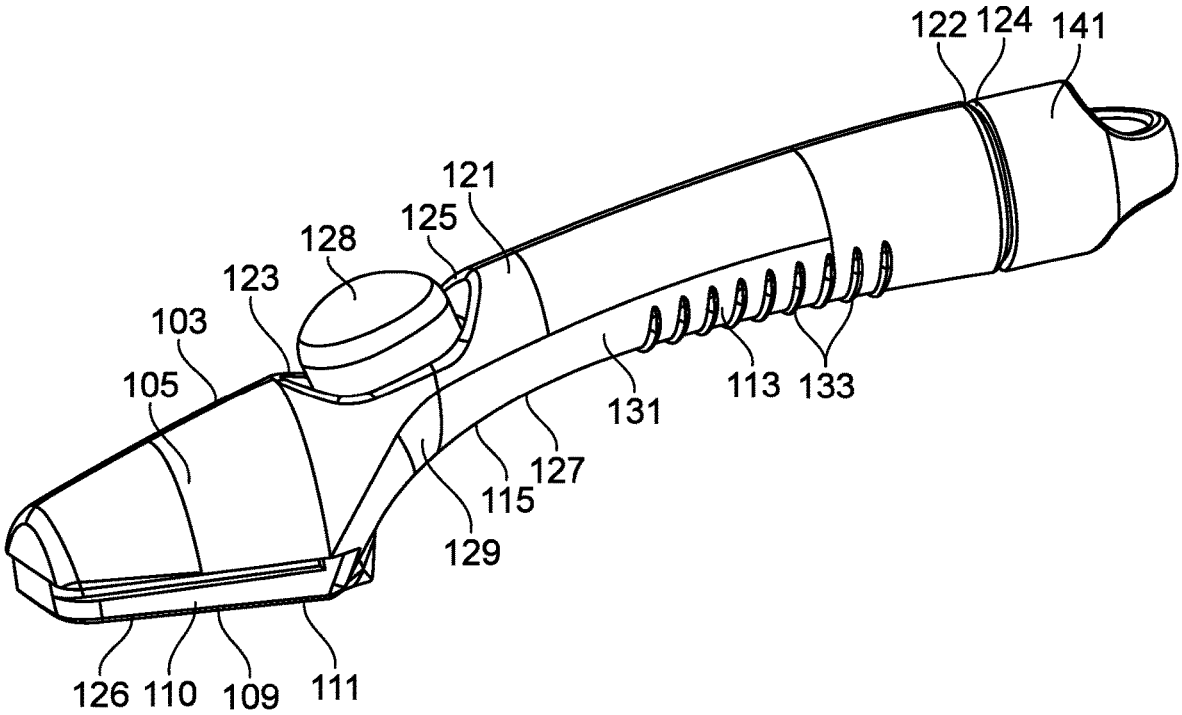
FIG. 1 illustrates a perspective view of the cleaning brush of the present invention.

FIG. 1 illustrates a perspective view of the refillable cleaning brush 100 of the present invention and the refillable brush 100 may include a cleaning head section 111 and a handle section 113 which may be connected to a neck section 115 which may be connected to the handle section 113.

The head cleaning section 111 may be substantially a rectangle with rounded corners and may include an inclined top wall 103 which may be opposed to a horizontal bottom wall 109 which may be connected to vertical sidewalls 105 which may connect to the inclined top wall 103.

The head cleaning section 111 may include a pair of opposing guides 110 which may be downward extending protrusions and which may extend from front to back of the head section 111 in order to guide the application of soap or detergent or other cleaning material along the path of the brush 100. The brush 100 may or may not include bristles.

The neck section 115 may include top curved neck wall 121 which may form a aperture 123 which may be defined by a peripheral neck wall 125 which may extend around the periphery of the aperture 123. Additionally, the neck section 115, may include a curved bottom wall 127 which may be opposed to the top curved neck wall 121 and which may be connected to a pair of opposing curved neck sidewalls 129 to connect the top curved neck wall 121 to the curved bottom wall 127. A bellows 128 may be positioned within the aperture 123 in order to pump the cleaning fluid through the dispensing outlet valve 126 which may be positioned on the bottom surface of the cleaning head section 111.

The handle section 113 may be substantially cylinder shaped and may include a cylinder surface 131 and may include ribs 133 which may be positioned axially along the bottom of the cylinder surface 131. The handle section 113 may include male threads 122 to cooperate with female threads 124 to allow the handle cap 141 to be detachably connected to the handle section 113 to allow the handle cap 141 to be removed to allow the cleaning fluid to be added to the hollow interior of the brush 100.

The brush 100 may be formed from a single integral construction with the exception of the dispensing outlet valve 126, the handle cap 141 and the bellows 128.

Figure 2:
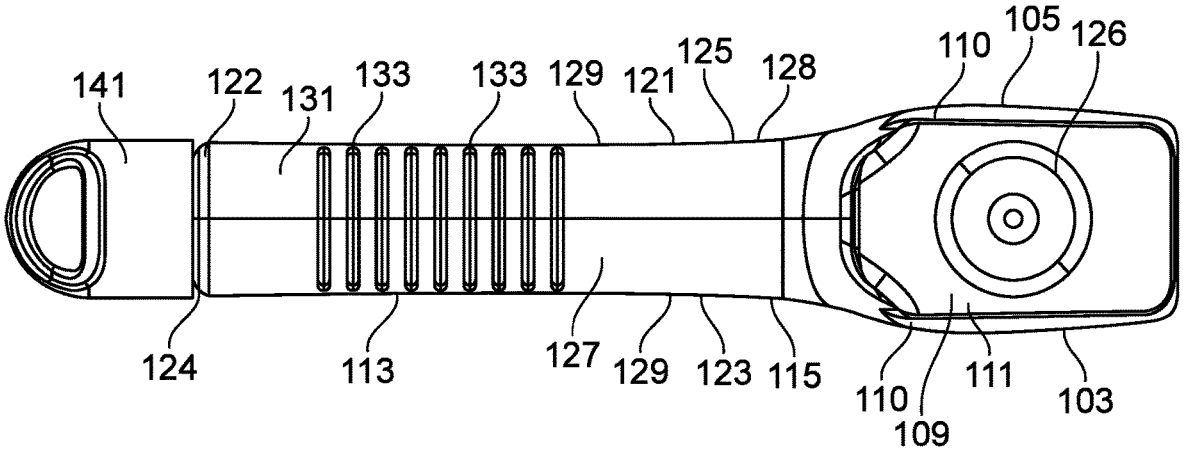
FIG. 2 illustrates a bottom view of the cleaning brush of the present invention.

FIG. 2 illustrates a bottom view of the refillable cleaning brush 100 of the present invention and the refillable brush 100 may include a cleaning head section 111 and a handle section 113 which may be connected to a neck section 115 which may be connected to the handle section 113.

The head cleaning section 111 may be substantially a rectangle with rounded corners and may include an inclined top wall 103 which may be opposed to a horizontal bottom wall 109 which may be connected to vertical sidewalls 105 which may connect to the inclined top wall 103.

The head cleaning section 111 may include a pair of opposing guides 110 which may be downward extending protrusions and which may extend from front to back of the head section 111 in order to guide the application of soap or detergent or other cleaning material along the path of the brush 100. The brush 100 may or may not include bristles.

The neck section 115 may include top curved neck wall 121 which may form a aperture 123 which may be defined by a peripheral neck wall 125 which may extend around the periphery of the aperture 123. Additionally, the neck section 115, may include a curved bottom wall 127 which may be opposed to the top curved neck wall 121 and which may be connected to a pair of opposing curved neck sidewalls 129 to connect the top curved neck wall 121 to the curved bottom wall 127. A bellows 128 may be positioned within the aperture 123 in order to pump the cleaning fluid through the dispensing outlet valve 126 which may be positioned on the bottom surface of the cleaning head section 111.

The handle section 113 may be substantially cylinder shaped and may include a cylinder surface 131 and may include ribs 133 which may be positioned axially along the bottom of the cylinder surface 131. The handle section 113 may include male threads 122 to cooperate with female threads 124 to allow the handle cap 141 to be detachably connected to the handle section 113 to allow the handle cap 141 to be removed to allow the cleaning fluid to be added to the hollow interior of the brush 100.

The brush 100 may be formed from a single integral construction with the exception of the dispensing outlet valve 126, the handle cap 141 and the bellows 128. The brush may be formed from rigid material such as plastic, wood, metal or other appropriate material. The bellows 128 may be flexible and maybe formed from plastic or other flexible material. When depressed, the bellows 128 may force the cleaning fluid out of the dispensing outlet valve 126.

Figure 3:
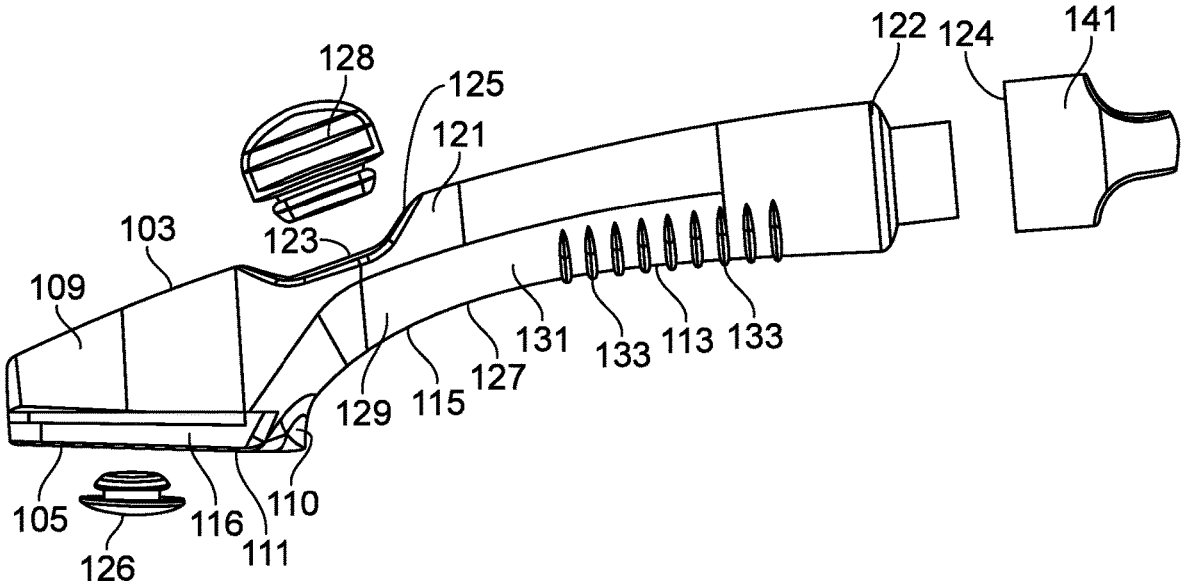
FIG. 3 illustrates a exploded view of the cleaning brush of the present invention.

FIG. 3 illustrates a exploded view of the refillable cleaning brush 100 of the present invention and the refillable brush 100 may include a cleaning head section 111 and a handle section 113 which may be connected to a neck section 115 which may be connected to the handle section 113.

The head cleaning section 111 may be substantially a rectangle with rounded corners and may include an inclined top wall 103 which may be opposed to a horizontal bottom wall 109 which may be connected to vertical sidewalls 105 which may connect to the inclined top wall 103.

The head cleaning section 111 may include a pair of opposing guides 110 which may be downward extending protrusions and which may extend from front to back of the head section 111 in order to guide the application of soap or detergent or other cleaning material along the path of the brush 100. The brush 100 may or may not include bristles.

The neck section 115 may include top curved neck wall 121 which may form a aperture 123 which may be defined by a peripheral neck wall 125 which may extend around the periphery of the aperture 123. Additionally, the neck section 115, may include a curved bottom wall 127 which may be opposed to the top curved neck wall 121 and which may be connected to a pair of opposing curved neck sidewalls 129 to connect the top curved neck wall 121 to the curved bottom wall 127. A bellows 128 may be positioned within the aperture 123 in order to pump the cleaning fluid through the dispensing outlet valve 126 which may be positioned on the bottom surface of the cleaning head section 111.

The handle section 113 may be substantially cylinder shaped and may include a cylinder surface 131 and may include ribs 133 which may be positioned axially along the bottom of the cylinder surface 131. The handle section 113 may include male threads 122 to cooperate with female threads 124 to allow the handle cap 141 to be detachably connected to the handle section 113 to allow the handle cap 141 to be removed to allow the cleaning fluid to be added to the hollow interior of the brush 100.

The brush 100 may be formed from a single integral construction with the exception of the dispensing outlet valve 126, the handle cap 141 and the bellows 128.

Figure 4:
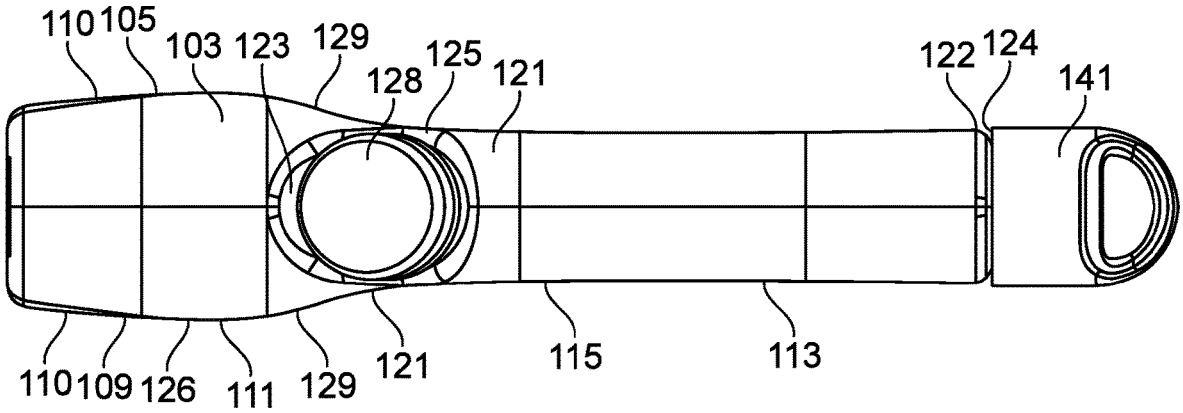
FIG. 4 illustrates a top view of the cleaning brush of the present invention.
Figure 5:
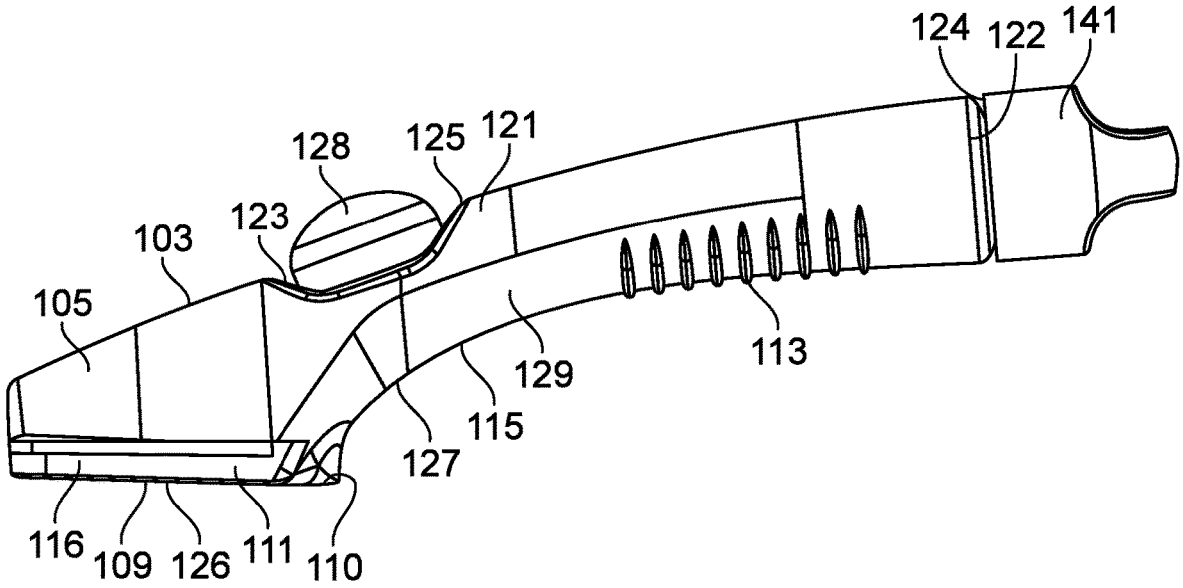
FIG. 5 illustrates a side view of the cleaning brush of the present invention.

FIG. 4 illustrates a top view of the cleaning brush of the present invention;

FIG. 5 illustrates a side view of the refillable cleaning brush 100 of the present invention and the refillable brush 100 may include a cleaning head section 111 and a handle section 113 which may be connected to a neck section 115 which may be connected to the handle section 113.

The head cleaning section 111 may be substantially a rectangle with rounded corners and may include an inclined top wall 103 which may be opposed to a horizontal bottom wall 109 which may be connected to vertical sidewalls 105 which may connect to the inclined top wall 103.

The head cleaning section 111 may include a pair of opposing guides 110 which may be downward extending protrusions and which may extend from front to back of the head section 111 in order to guide the application of soap or detergent or other cleaning material along the path of the brush 100. The brush 100 may or may not include bristles.

The neck section 115 may include top curved neck wall 121 which may form a aperture 123 which may be defined by a peripheral neck wall 125 which may extend around the periphery of the aperture 123. Additionally, the neck section 115, may include a curved bottom wall 127 which may be opposed to the top curved neck wall 121 and which may be connected to a pair of opposing curved neck sidewalls 129 to connect the top curved neck wall 121 to the curved bottom wall 127. A bellows 128 may be positioned within the aperture 123 in order to pump the cleaning fluid through the dispensing outlet valve 126 which may be positioned on the bottom surface of the cleaning head section 111.

The handle section 113 may be substantially cylinder shaped and may include a cylinder surface 131 and may include ribs 133 which may be positioned axially along the bottom of the cylinder surface 131. The handle section 113 may include male threads 122 to cooperate with female threads 124 to allow the handle cap 141 to be detachably connected to the handle section 113 to allow the handle cap 141 to be removed to allow the cleaning fluid to be added to the hollow interior of the brush 100.

The brush 100 may be formed from a single integral construction with the exception of the dispensing outlet valve 126, the handle cap 141 and the bellows 128.

Figure 6:
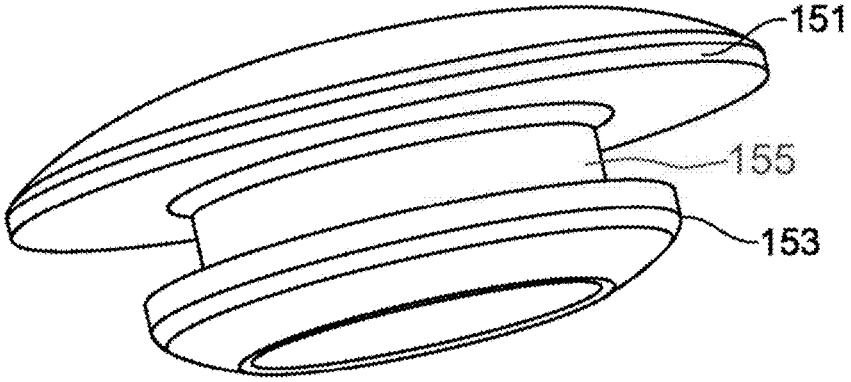
FIG. 6 illustrates a dispensing outlet valve of the cleaning brush of the present invention.

FIG. 6 illustrates a dispensing outlet valve 126 of the cleaning brush 100 of the present invention which may include an outer ring 151, an inner ring 153 and a center ring 155 which may be a reduced diameter with respect to the outer ring 151 and the inner ring 153. The dispensing outlet valve may be flexible in order to be inserted into the cleaning brush 100.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed.

The invention claimed is:

1. A brush device for dispensing a cleaning fluid, comprising:

a hollow body having a handle section, a neck section and a cleaning head section, with said neck section disposed between said cleaning head section and said handle section, and wherein said hollow body is formed from a single integral construction;

an aperture formed into said neck section of said hollow body;

a bellows configured for disposing in said aperture formed in said hollow body, wherein said bellows is formed of flexible material adapted for depressing to force the cleaning fluid through a dispensing outlet valve; and said dispensing outlet valve being positioned on a bottom surface of said cleaning head section of said hollow body to dispense the cleaning fluid from said brush device, wherein said dispensing outlet valve has an outer ring, a center ring and an inner ring, with said center ring being a reduced diameter with respect to said outer ring and said inner ring, and wherein said dispensing outlet valve is flexible in order for said inner ring to be inserted into said cleaning head section of said hollow body of said brush device.

2. The brush of claim 1, wherein said hollow body includes a pair of opposing guides provided by protrusions which downwardly extend from said cleaning head section, from a front to a back of said cleaning head section.

3. The brush device of claim 1, further comprising a handle cap which is detachably connected to said handle section for removing to add the cleaning fluid to said hollow body of said brush device.

4. The brush of claim 1, wherein said hollow body includes a pair of opposing guides provided by protrusions which downwardly extend from said cleaning head section, from a front to a back of said cleaning head section.

5. A brush device for dispensing a cleaning fluid, comprising:

a hollow body having a handle section, a neck section and a cleaning head section, with said neck section disposed between said cleaning head section and said handle section, and wherein said hollow body is formed from a single integral construction;

an aperture formed into said neck section of said hollow body;

a bellows configured for disposing in said aperture formed in said hollow body, wherein said bellows is formed of flexible material adapted for depressing to force the cleaning fluid through a dispensing outlet valve; and said dispensing outlet valve being positioned on a bottom surface of said cleaning head section of said hollow body to dispense the cleaning fluid from said brush device, wherein said dispensing outlet valve has an outer ring, a center ring and an inner ring, with said center ring being a reduced diameter with respect to said outer ring and said inner ring, and wherein said dispensing outlet valve is flexible in order for said inner ring to be inserted into said cleaning head section of said hollow body of said brush device; and a handle cap which is detachably connected to said handle section for removing to add the cleaning fluid to said hollow body of said brush device.

* * * * *